US010981399B2

(12) United States Patent
Huang

(10) Patent No.: US 10,981,399 B2
(45) Date of Patent: Apr. 20, 2021

(54) MEDIA GUIDES

(71) Applicant: Hewlett-Packard Development Company, L.P., Spring, TX (US)

(72) Inventor: Xiaoxi Huang, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/612,985

(22) PCT Filed: Sep. 5, 2017

(86) PCT No.: PCT/US2017/050081
§ 371 (c)(1),
(2) Date: Nov. 12, 2019

(87) PCT Pub. No.: WO2019/050502
PCT Pub. Date: Mar. 14, 2019

(65) Prior Publication Data

US 2020/0171860 A1 Jun. 4, 2020

(51) Int. Cl.
*B41J 15/04* (2006.01)

(52) U.S. Cl.
CPC ..... *B41J 15/046* (2013.01)

(58) Field of Classification Search
CPC ... B41J 15/00; B41J 15/02; B41J 15/04; B41J 15/044; B41J 15/048; B41J 15/18; B41J 15/046; B41J 11/485; B41J 11/0025; B41J 11/0045; B41J 17/02; B41J 17/18; B41J 17/20; B41J 13/0054; B41J 13/103;
(Continued)

(56) References Cited

U.S. PATENT DOCUMENTS 4,498,794 A 2/1985 Waibel
5,180,233 A 1/1993 Kim
5,875,383 A 2/1999 Stemmle
(Continued)

FOREIGN PATENT DOCUMENTS

JP H02113974 A 4/1990
JP H0465269 A 3/1992

OTHER PUBLICATIONS

Unknown, "Epson SureColor P6000 & P8000",Professional 24 & 44-Inch 8-Color Photographic Printers, Product Preview v1.0, Aug. 2015, 18 pages.

*Primary Examiner* — Kristal Feggins
(74) *Attorney, Agent, or Firm* — HP Inc. Patent Department

(57) ABSTRACT

In an example, a media guide assembly includes a support structure, a first media guide, and a second media guide moveably coupled to the support structure. In that example, the second media guide includes a surface that generates a wedge effect to move the second media guide to a level when contacted by a force. In another example, an example print apparatus includes a support structure, a first media guide, and a second media guide substantially parallel to the first media guide with respect to a media advance direction. In that example, the second media guide includes a position control mechanism to place force on a media path surface of the second media guide towards a rest position where the media path surface of the second media guide is substantially parallel to the media path surface of the first media guide.

15 Claims, 9 Drawing Sheets

(58) Field of Classification Search
CPC .... B41J 13/106; B41J 11/006; B41J 11/0065; B41J 11/007
See application file for complete search history.

(56) References Cited

U.S. PATENT DOCUMENTS

| | | | | |
|---|---|---|---|---|
| 6,280,106 | B1 | 8/2001 | Juan et al. | |
| 7,551,875 | B2 | 6/2009 | Amarakoon | |
| 7,831,191 | B2 | 11/2010 | Mandel | |
| 2006/0228148 | A1* | 10/2006 | Tobin | B41J 29/13 400/120.17 |
| 2014/0183815 | A1* | 7/2014 | Reidhaar | B65H 5/26 271/225 |
| 2017/0320701 | A1* | 11/2017 | Hale | B65H 5/26 |
| 2018/0164740 | A1* | 6/2018 | Ballman | G03G 21/1685 |

* cited by examiner

MEDIA GUIDES

BACKGROUND

Images are processed for use with computing machines, such as a print apparatus. A print apparatus, for example, may use control data based on processed image data to reproduce a physical representation of an image by operating a print fluid ejection system according to the control data. A user of a print apparatus may be able to choose from a variety of medias, such as a variety of types and/or sizes, to produce the image.

DETAILED DESCRIPTION

In the following description and figures, some example implementations of print apparatus, media guide assemblies, and/or methods of media guide modification are described. In examples described herein, a "print apparatus" may be a device to print content on a physical medium (e.g., paper, textiles, a layer of powder-based build material, etc.) with a print material (e.g., ink or toner). For example, the print apparatus may be a wide-format print apparatus that prints latex-based print fluid on a print medium, such as a print medium that is size A2 or larger. In some examples, the physical medium printed on may be a web roll or a pre-cut sheet. In the case of printing on a layer of powder-based build material, the print apparatus may utilize the deposition of print materials in a layer-wise additive manufacturing process. A print apparatus may utilize suitable print consumables, such as ink, toner, fluids or powders, or other raw materials for printing. In some examples, a print apparatus may be a three-dimensional (3D) print apparatus. An example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like. The material to be printed on (i.e., print media) may come in a variety of types and forms. For example, a large format print apparatus may use media web rolls and may include an accessory tray to hold pre-cut sheets, such as A3 or letter size sheets of paper.

Various examples described below relate to providing an adjustable media guide to allow insertion and removal of a media tray onto a print apparatus. By enabling a section of the media guide assembly to be adjustable, a user can decide to use the media guide assembly with a second roll holder or to adapt the media guide holder to an accessory, such as a cut sheet tray, instead.

Figure 1:
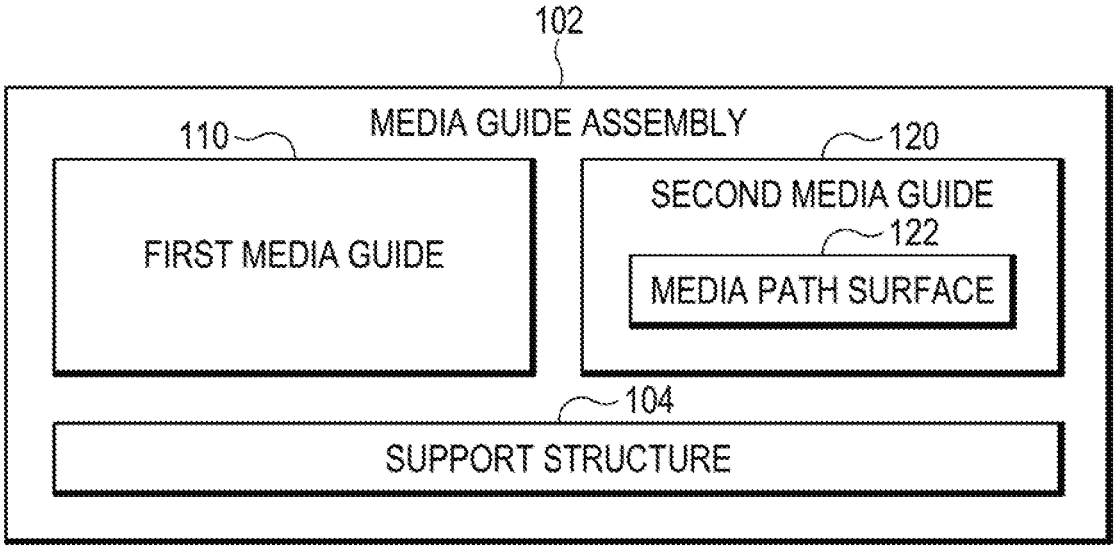
FIG. 1 is a block diagram depicting an example media guide assembly.

FIG. 1 is a block diagram depicting an example media guide assembly 102. Referring to FIG. 1, a media guide assembly 102 generally includes a support structure 104 to support a first media guide 110 and a second media guide 120. The support structure 104 may extend across a media path (e.g., below where the media is to be supported on the way to the print zone of a print apparatus.) The first media guide and the second media guide are adjacent to each other with respect to a width of a media path, where the width of the media path is perpendicular to the media advance direction (e.g., the direction of media as it passes over the media guide assembly). The first media guide 110 may be fixedly coupled to the support structure 104 and the second media guide 120 may be moveably coupled to the support structure. In this manner, a section of media guide assembly is considered adjustable. For example, the second media guide 120 may be biased with a bias mechanism, such as a spring or lever, where the media path surface 122 moves consistent with the bias mechanism and any external force placed on the media path surface 122. The media path surface 122 may enable movement of the media guide. For example, the second media guide may include a surface that generates a wedge effect to move the second media guide to a lower vertical level when contacted by a horizontal force in the media advance direction.

In some examples, functionalities described herein in relation to any of FIGS. 1-10 may be provided in combination with functionalities described herein in relation to any of FIGS. 1-10.

Figure 2:
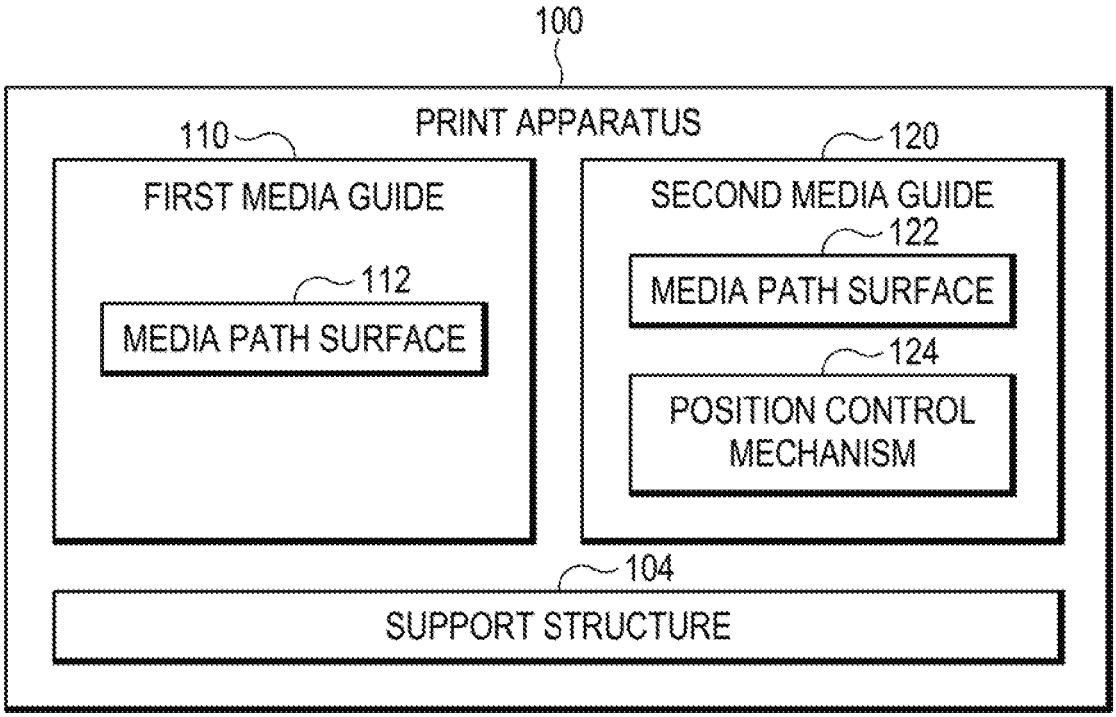
FIGS. 2 and 3 are block diagrams depicting example print apparatus.
Figure 3:
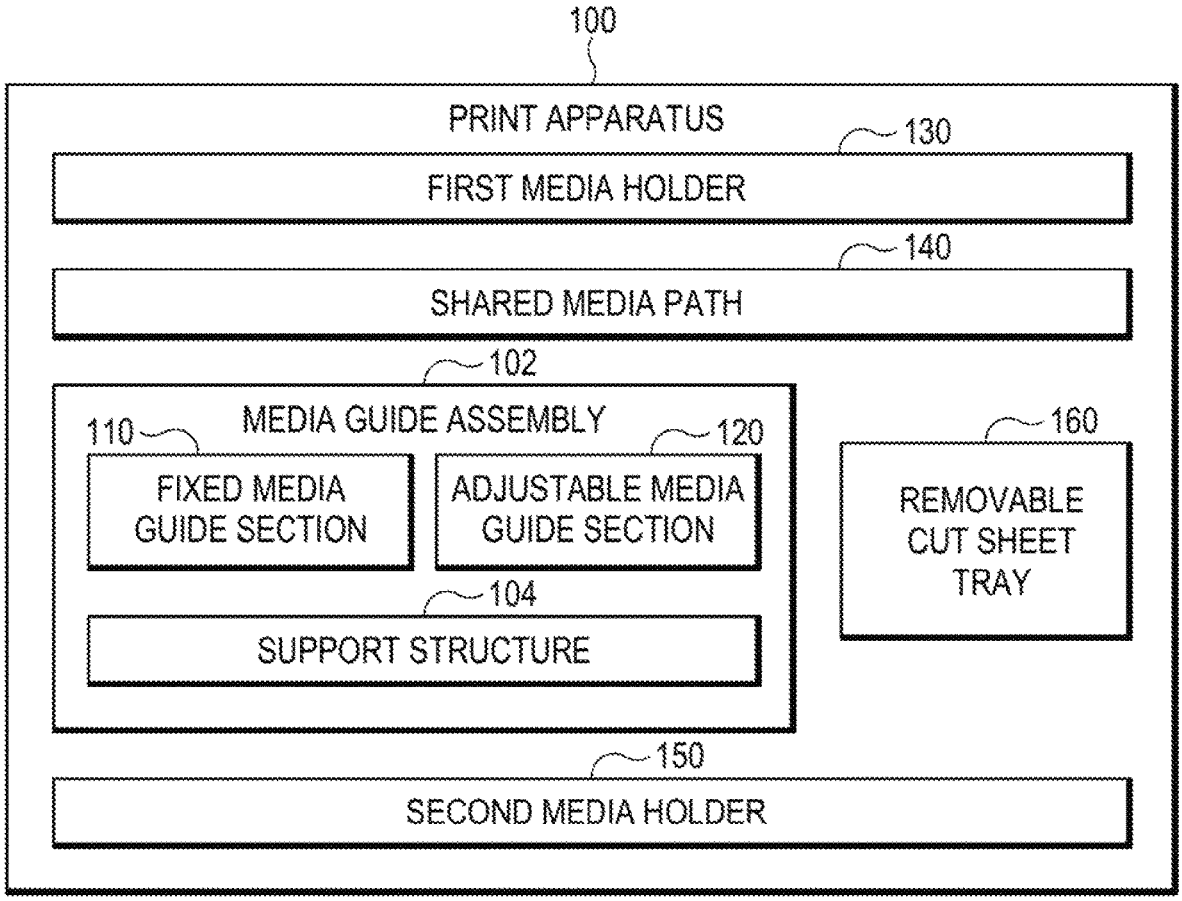

FIGS. 2 and 3 are block diagrams depicting example print apparatus 100. Referring to FIG. 2, the print apparatus 100 generally includes a support structure 104, a first media guide 110, and a second media guide 120. As mentioned with reference to FIG. 1, the support structure 104 extends across a width of a media path and supports a first media guide coupled to the support structure and a second media guide coupled to the support structure substantially parallel to the first media guide with respect to the media advance direction. In this manner, the first media guide and the second media guide may both have media path surfaces 112 and 122 that may be parallel to each other across the width of the media path. In this manner, the media guides 110 and 120 may complement each other as a media guide across a particular location of the media path of a print apparatus even though the first media guide may be fixed and the second media guide may be adjustable in height.

A position control mechanism 124 may be coupled to the media path surface 122. The position control mechanism 124 generates force on the media path surface 122 of the media guide 120 towards a rest position where the media path surface 122 of the media guide 120 is substantially parallel to the media path surface 112 of the fixed media guide 110. The position control mechanism 124 may be any appropriate hardware to enable the adjustable media guide 120 to move to different positions, such as a spring, a lever, a slide, etc., or a combination thereof. The position control mechanism 124 may enable step movement or continuous movement along a range of positions, and the position control mechanism 124 may be moveable manually and/or controlled by a controller. The position control mechanism 124 may include features to enable the adjustable media guide 120 to be sustained at a particular position. For example, a bias lock interface may exist on the support structure 104 that couples to the adjustable media guide to maintain a spring in a compressed position.

Referring to FIG. 3, a print apparatus may generally include a shared media path 140, multiple media holder assemblies 130 and 150, and a media guide assembly 102 where the media guide assembly 102 includes an adjustable media guide section the moves to allow a removable cut sheet tray 160 to be attached to the support structure 104. The media holder assemblies 130 and 150 may include hubs, such as hub 152 of FIG. 4, to connect to a media roll. Example media holders with hubs (e.g., mechanisms to connect to the media roll) include spindle media holders and spindleless media holders that connects to the media roll via the core of the media roll. The media holder assemblies 130 may be adjustable to accommodate different widths, lengths, types and/or size attributes of media rolls. For example, the first media holder assembly may be connectable to a first type of roll media and the second media holder assembly may be connectable to a second type of roll media. A print apparatus with multiple web media holders may, therefore, hold multiple types of media and provide a variety of choices to a user. With a removable cut sheet tray attached, even more types of media, in particular pre-cut sheet media, is available to the user. In this manner, the print apparatus 100 may be adaptable to the type of printing performed by the user, for example.

The media guide assembly 102 of FIG. 3 includes a fixed media guide section having a media contact section and an adjustable media guide section having a media contact surface with a shape corresponding to the shape of the media contact section of the fixed media guide section. The adjustable media guide section 120 and the fixed media guide section 110 of the media guide assembly 102 are aligned across a media path width perpendicular to a media advance direction.

The removable cut sheet tray 160 is coupleable to a section of the support structure corresponding to the adjustable media guide section 120. The adjustable media guide section may be in a collapsed position when the cut sheet tray is attached and may move towards the height of the fixed media guide section when the removable cut sheet tray is removed.

Figure 4:
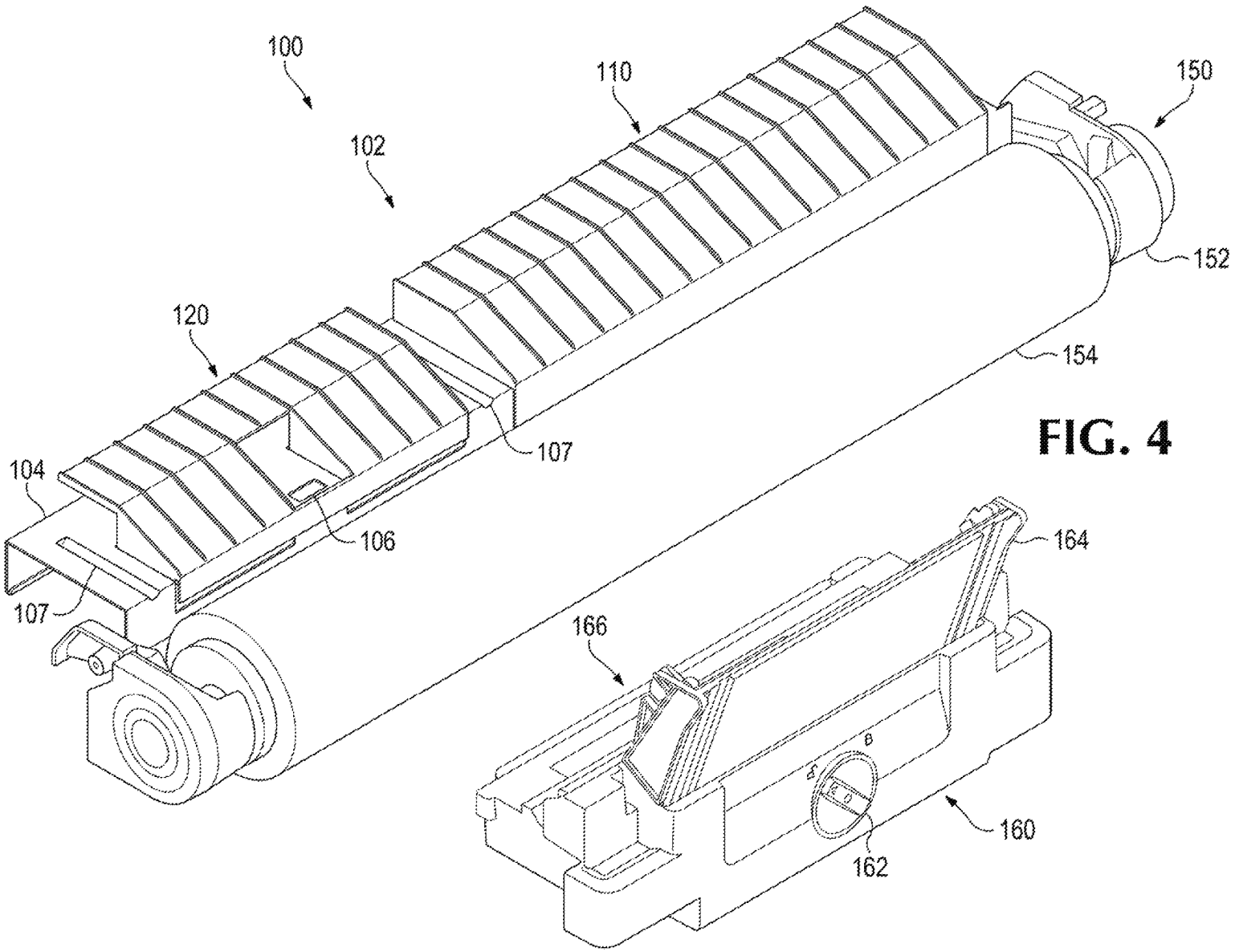
FIGS. 4 and 5 depict example states of an example media holder of an example print apparatus.
Figure 5:
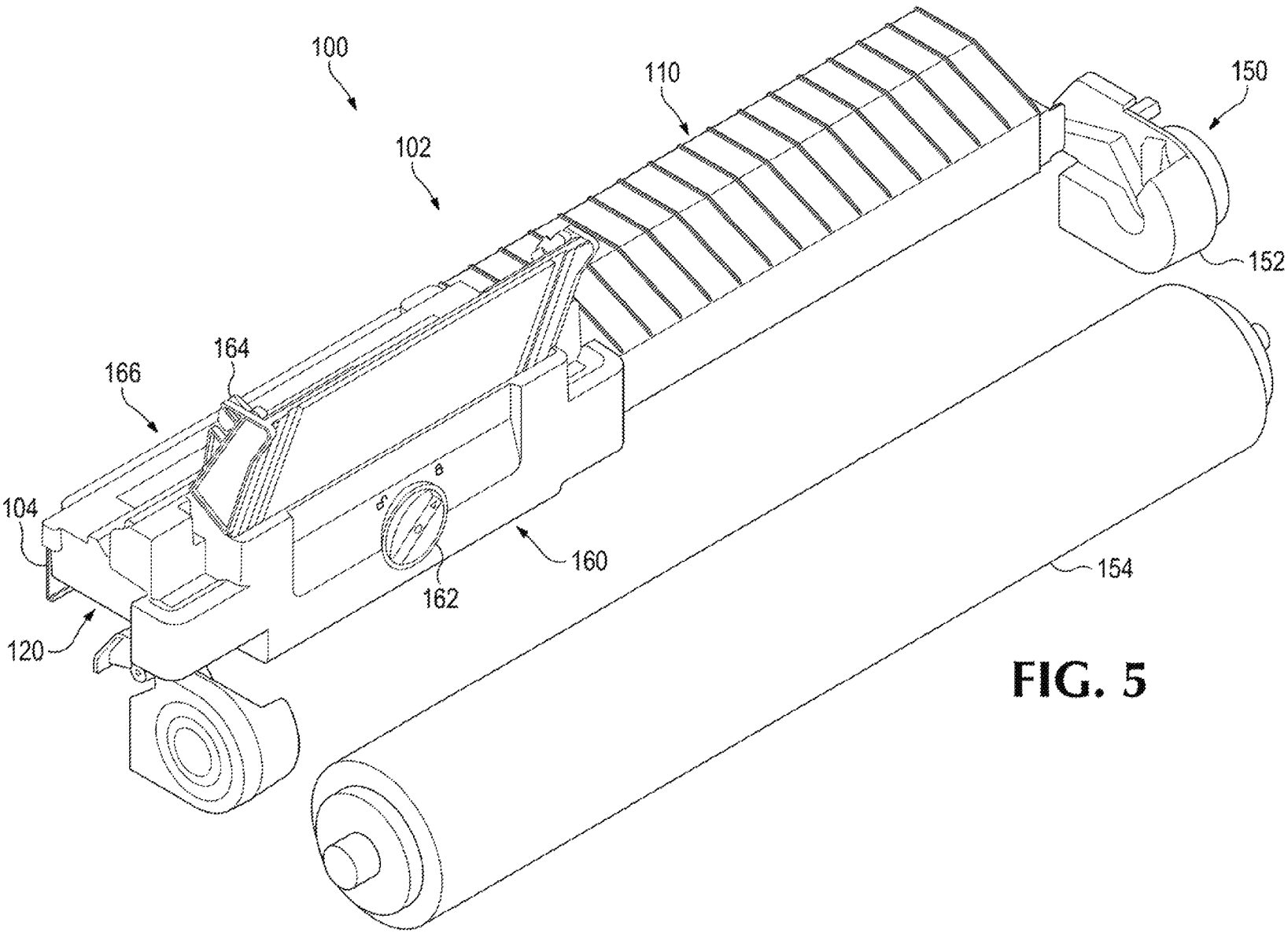

FIGS. 4 and 5 depict example states of an example media holder 150 of an example print apparatus 100. Referring to FIG. 4, the print apparatus 100 may be in a state to use a second media roll. The media guide assembly 102 includes a first media guide 110 and a second media guide 120 in an upright position. Media attached to the media hub 152 of the media holder 150 from the media roll 154 may advance over the media guides 110 and 120. Referring to FIG. 5, the print apparatus 100 may be in a state to use the removable cut sheet tray assembly 160 instead of the web media when the web media 154 is not installed in the media hub 152. The cut sheet tray assembly 160 may include a media tray 164, a media path interface 166, and a tray lock mechanism 162 that couples the cut sheet tray assembly 160 to a lock feature (such as lock feature 106 of FIG. 7) when the tray lock mechanism 162 is activated. The lock mechanism 162 is depicted as having a user adjustable handle to manually rotate the lock mechanism from an unlocked orientation of a locked orientation and vice versa. In other examples, the lock mechanism 162 may change orientation by interaction with mechanical means on the print apparatus 100, controlled by a controller, or some other form without direct intervention by the user.

Figure 6:
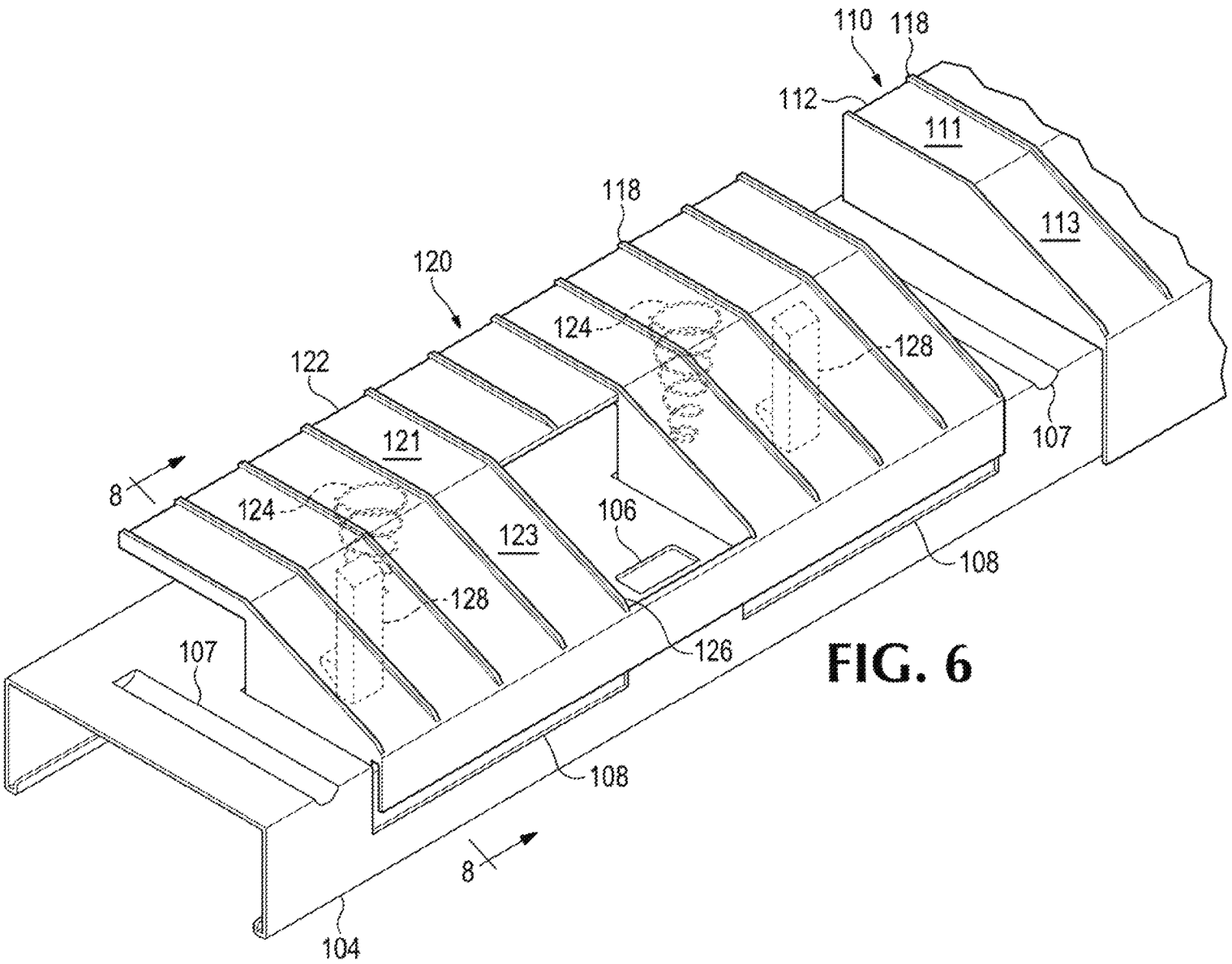
FIGS. 6 and 7 depict example positions of an example adjustable media guide.
Figure 7:
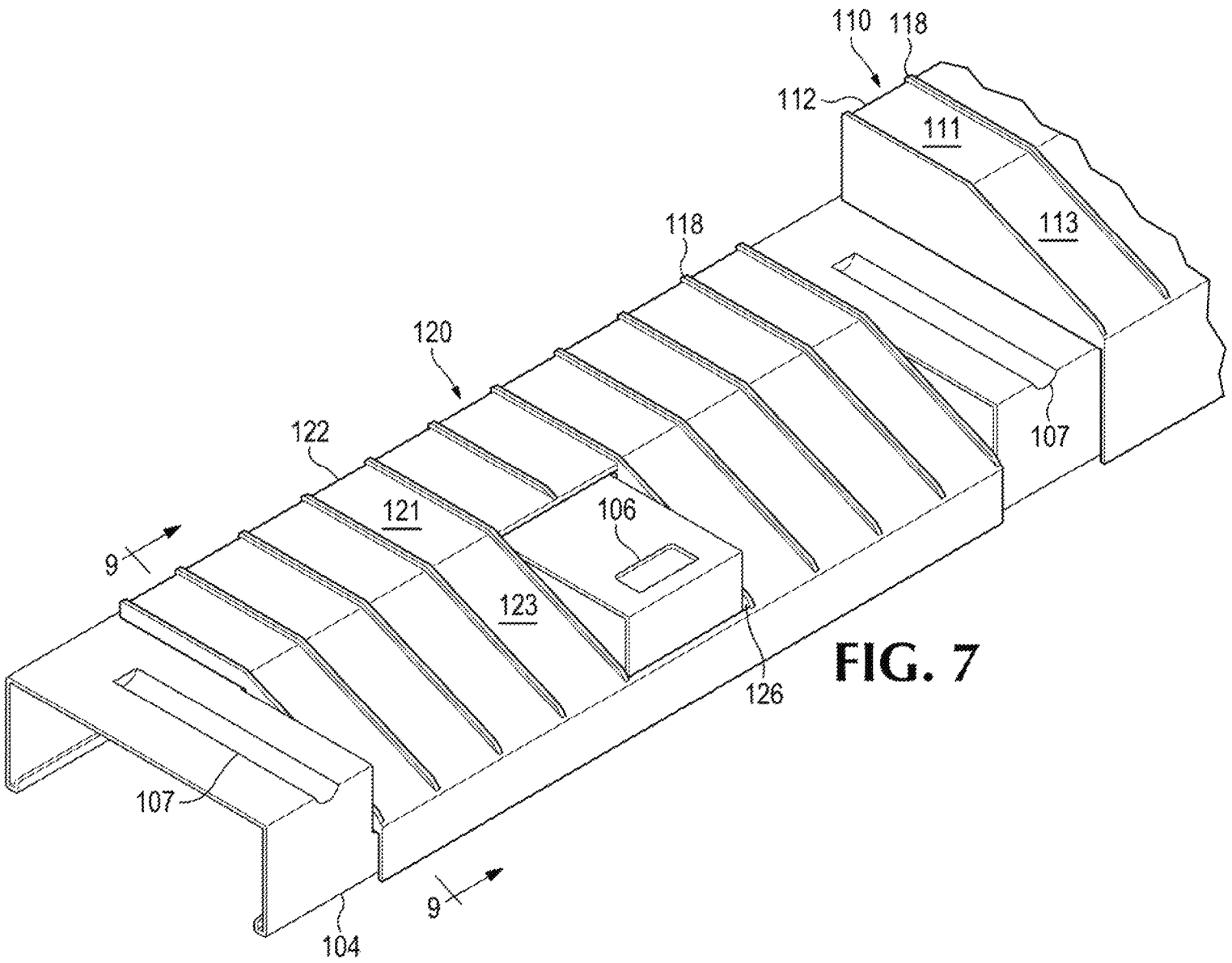

FIGS. 6 and 7 depict example positions of an example adjustable media guide 120. Referring to FIG. 6, the support structure 104 may define a plurality of channels 107 to accept a structure of the cut sheet tray assembly 160 and guide the cut sheet tray assembly 160 to move horizontally over the support structure (e.g., above the adjustable media guide 120 as the adjustable media guide 120 moves downward).

The first media guide 110 and/or the second media guide 120 may include ribs 118 attached to the media path surfaces 112 and 122. The media path surfaces 112 and 122 may include faces 111, 113, 121, and 123 that face towards the media and define a shape of media guides. For example, the faces 111 and 121 may be substantially parallel to a shared media path and faces 113 and 123 may be sloped with respect to faces 111 and 121. The faces 111, 113, 121, and 123 may be complementary and/or substantially equal. For example, the faces 121 and 123 may be in a position parallel to the faces 111 and 113 when the adjustable media guide 120 is in a rest position based on the bias force provided by the position control mechanism 124 (e.g., spiral springs).

The position control mechanism 124 may include two or more states. For example, the springs may be fully extended with respect to the weight of the media guide 120 or fully compressed, such as shown in FIG. 7. The position control mechanism 124 may bias or otherwise control the height of the adjustable media guide 120. The adjustable media guide and the support structure may include complementary sliding features to allow the adjustable media guide to move along a desired path (e.g., move vertically with horizontal restrictions). A plurality of slide guides 128 may be coupled to the support structure 104 to guide the adjustable media guide to move vertically within the plurality of slide guides (e.g., via plurality of leg features extending vertically from the media guide surface). The adjustable media guide 120 may move into recesses 108 defined in the support structure 104. The recesses 108 may be defined to receive and otherwise accommodate the shape of the media guide 120.

Referring to FIG. 7, the support structure 104 may include a lock feature 106 that is exposable when the adjustable media guide 120 moves inside the recess 108 of the support structure 104. For example, the media guide surface 122 may define an aperture 126 to allow the lock feature 106 to become exposed when the media path surface 122 is moved out of the rest position as shown in FIG. 7. The surface 122 of the media guide 120 may define an aperture 126 greater than the size of the lock feature 106. In another example, the lock feature may appear or otherwise be accessible by the accessory on a vertical side of the support structure. In yet other examples, multiple lock features may be exposed to allow complimentary lock mechanisms to attach the cut sheet tray to multiple points of the support structure 104.

FIG. 7 depicts slide channels 107 that allow for the cut street tray to be placed over the adjustable media guide 120 and move into a lockable position on the support structure 104. The fixed media guide 110 stays at the same height while the adjustable media guide 120 moves from the rest position to the compressed position (e.g., the higher vertical height to the lower vertical height where the adjustable media guide 120 is located within the recesses 108 of the support structure 104).

Figure 8:
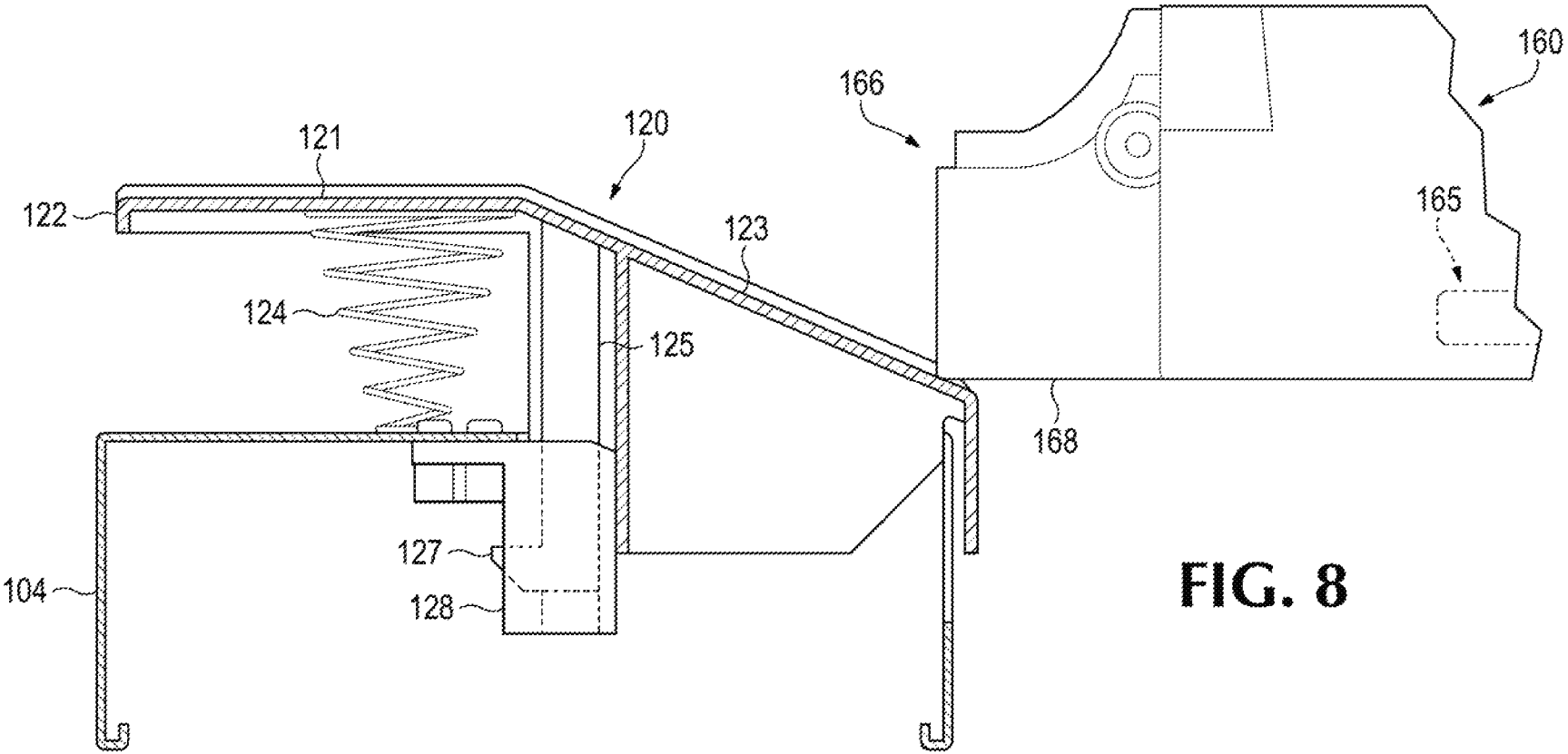
FIGS. 8 and 9 are side views of example positions of an example adjustable media guide with respect to an example cut sheet tray.
Figure 9:
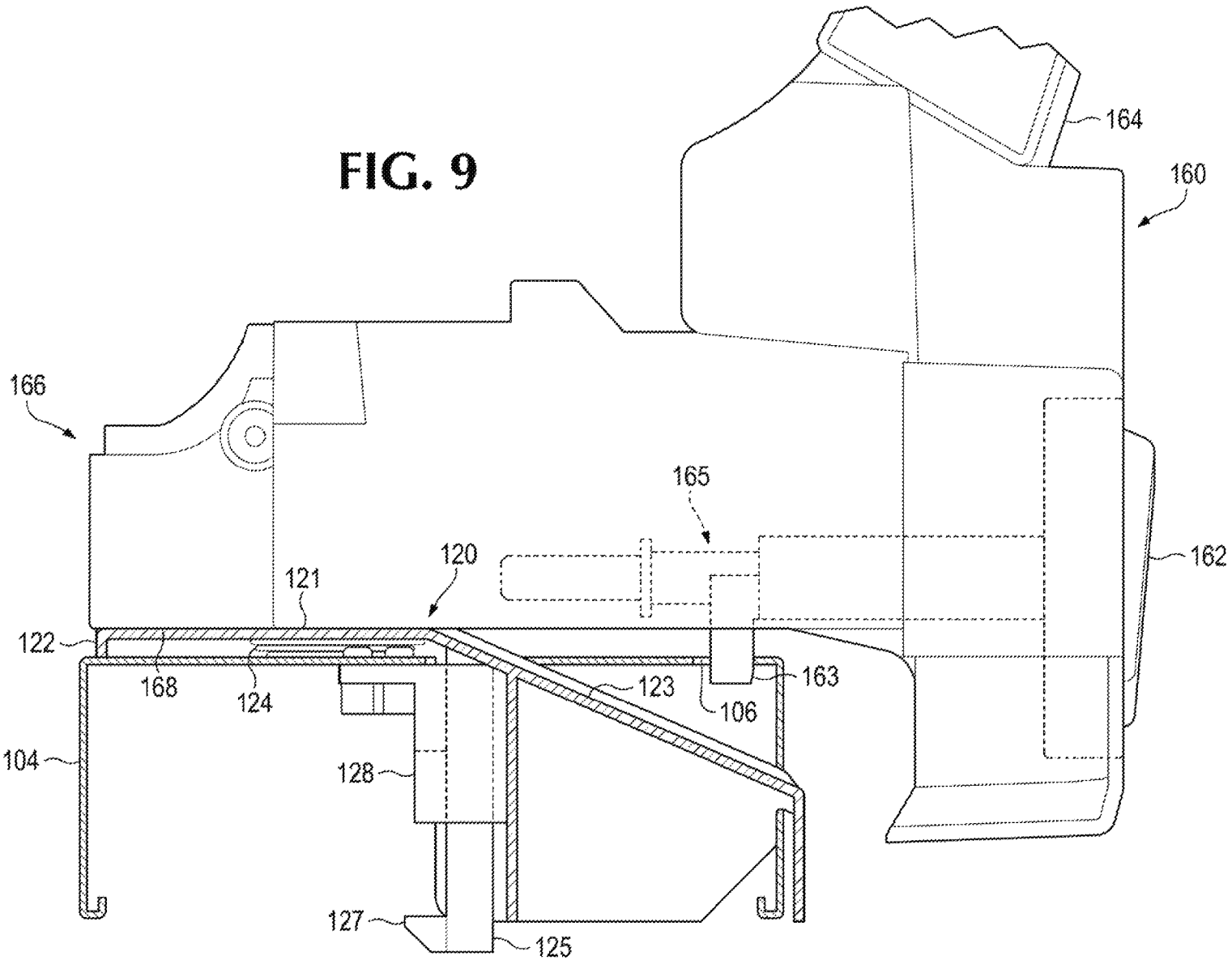

FIGS. 8 and 9 are side views of example positions of the adjustable media guide 120 with respect to an example cut sheet tray 160. FIG. 8 is a side view provided with respect to the point of view of position 8 as identified in FIG. 6 and FIG. 9 is a side view provided with respect to the point of view of position 9 as identified in FIG. 7. Referring to FIG. 8, the bias force of the position control mechanism 124 pushes the adjustable media guide 120 upwards and legs 125 of the adjustable media guide 120 may include a stop feature 127 to sustain the adjustable media guide at a rest position.

The stop feature 127 is coupled to the slide guide 128 to hinder the leg feature 125 from exiting the slide guide 128.

The cut sheet tray 160 is pushed against the adjustable media guide 120. A contact surface 168 makes contact with the face 123, which is at a slope with respect to the face 121. As the tray assembly 160 produces force on the adjustable media guide 120, the contact surface 168 interacts with the sloped surface 123 to generate a wedge effect of force from the contact surface 168 on the surface 122 to move the leg 125 through the slide guide 128 and, in this manner, moves the adjustable media guide out of the rest position towards the position depicted in FIG. 9.

Referring to FIG. 9, the cut-sheet tray assembly 160 has moved into an installed position where the contact surface 168 touches the face 121 of the adjustable media guide 120. The adjustable media guide 120 has accommodated by moving into a lower position enabled by the position control mechanism 124 (e.g., the compression of the springs and interaction of the slide guide 128 with the leg 125). As mentioned herein, the support structure 104 receives the adjustable media guide 120 into a compressed position (e.g., received into recesses defined in the support structure) and the media guide assembly 102 receives the cut sheet tray assembly 160 into slide channels 107 defined on the surface of the support structure 104. With the adjustable media guide 120 recessed in the support structure 104, the lock feature 106 of the support structure 104 is exposed through the aperture of the adjustable media guide surface 122 or otherwise made available to interact with the lock mechanism 162 of the cut sheet tray assembly 160 when the adjustable media guide 120 is in the compressed position.

The lock feature 106 may have a complementary lock feature on the cut sheet tray assembly 160. Complimentary lock features of the cut sheet tray assembly 160 may include features 163 and 165 as shown in FIG. 9. For example, once the assembly is located in the proper position over the lock feature the handle of the lock mechanism 162 may be rotated to move the complimentary lock extrusion 163 extending from the rotatable feature 165 into the lock feature 106.

When the cut sheet tray assembly 160 is locked in position, the media interface 166 of the cut sheet tray assembly 160 may be positioned at a location similar the face 121 of the adjustable media guide surface 122 when the adjustable media guide is at a rest position. For example the media interface 166 may be located at a height level equivalent to the height level of the face 121 when the adjustable media guide is at a rest position to interact with the shared media path as would be used by a web roll media holder when the adjustable media guide is in the rest position.

Figure 10:
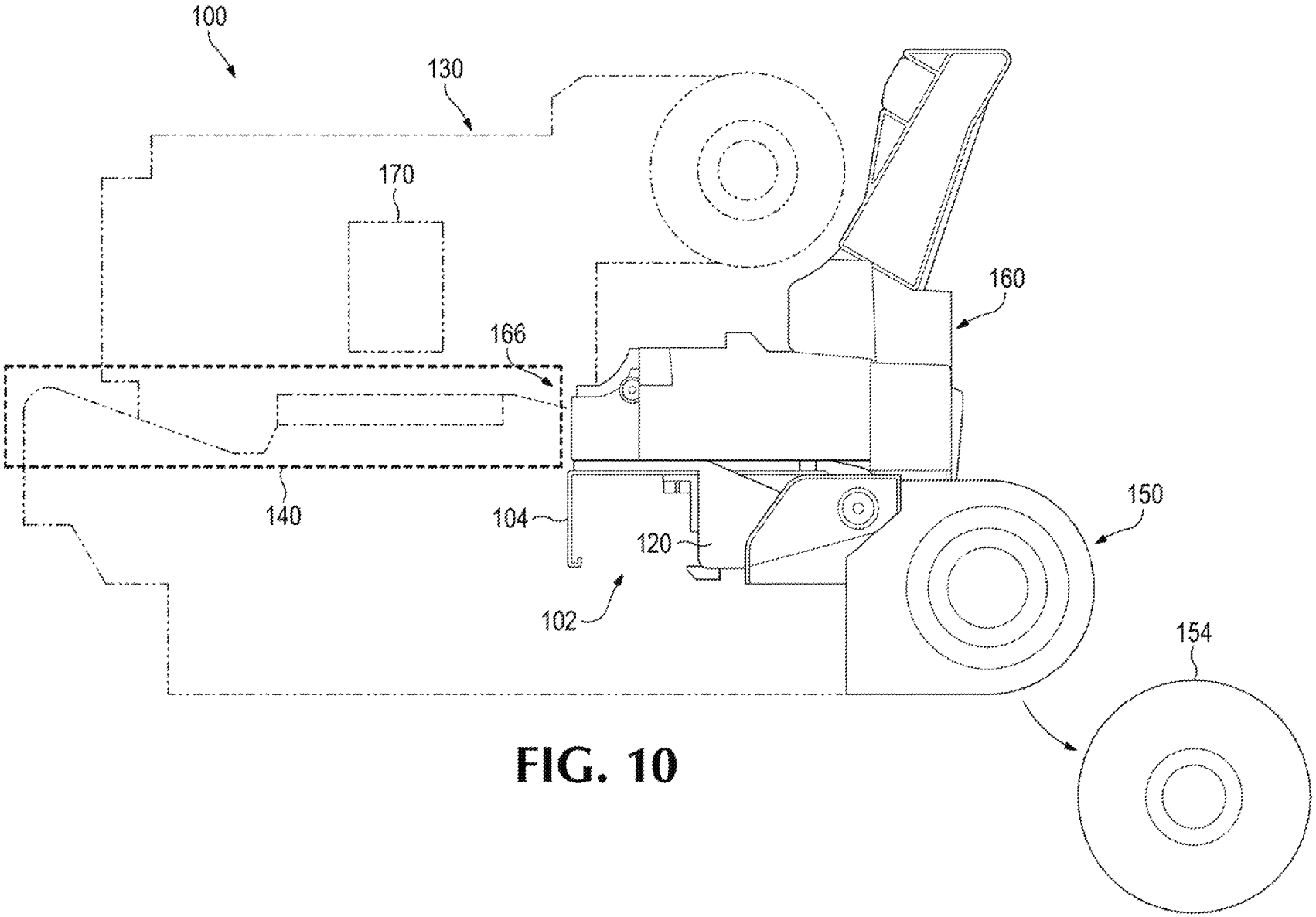
FIG. 10 depicts an example environment of an example print apparatus including an example media guide assembly.

FIG. 10 depicts an example environment of an example print apparatus 100 including an example media guide assembly 102. Referring to FIG. 10, the print apparatus 100 generally includes a first media holder 130, second media holder 150, a removable cut sheet tray 160, a print head 170, a media guide assembly 102, and a shared media path 140. The print apparatus 100 is capable of using media from the first media holder 130, the second media holder 150, or the cut sheet tray 160. In this manner, the print apparatus 100 may be considered to have a three-in-one media input path. The shared media path 140 is the media path within the printer that allows for media to enter and exit the print zone (i.e., the location on the media path where the print head 170 is able to deposit print fluid on media) regardless of the source of the media. For example, with the cut sheet tray assembly 160 removed (e.g., not installed), the shared media path 140 may receive web media from the first media holder 130 or the second media holder 150.

FIG. 10 depicts an operational state of the print apparatus 100 where the removable cut sheet tray 160 is installed on the media guide assembly 102 (e.g., connected to the support structure 104 and located over the compressed adjustable media guide 120). In this operational state, the print apparatus 100 is able to pick sheet media from the cut sheet tray assembly 160 to be provided to the shared media path 140 and unable to advance media from the second media holder 150.

The removable cut sheet tray 160 may be installed or removed based on whether a user desires to be using multiple web rolls or to be printing on pre-cut sheets. In this manner, the shared media path 140 may receive media from the first media holder 130 and either (a) the cut sheet tray 160 when the cut sheet tray assembly 160 is installed on the media guide assembly 102 or (b) the second media holder 150 (when the removable cut sheet tray is not installed on the media guide assembly 102). With this capability, a user of the print apparatus 100 is able to select a variety of media source to print on and may change between using multiple types of roll media or using pre-cut sheet media, as examples.

All of the features disclosed in this specification (including any accompanying claims, abstract and drawings), and/or all of the elements of any method or process so disclosed, may be combined in any combination, except combinations where at least some of such features and/or elements are mutually exclusive.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus. Furthermore, the use of the words "first," "second," or related terms in the claims are not used to limit the claim elements to an order or location, but are merely used to distinguish separate claim elements.

The present description has been shown and described with reference to the foregoing examples. It is understood, however, that other forms, details, and examples may be made without departing from the spirit and scope of the following claims.

What is claimed is:

1. A print apparatus comprising:

a support structure extending across a width of a media path;

a first media guide coupled to the support structure, the first media guide having a media path surface; and an second media guide coupled to the support structure substantially parallel to the first media guide with respect to a media advance direction, the second media guide including:

a media path surface; and a position control mechanism coupled to the media path surface of the second media guide, the position control mechanism to place force on the media path surface of the second media guide towards a rest position where the media path surface of the second media guide is substantially parallel to the media path surface of the first media guide.

2. The apparatus of claim 1, further comprising ribs attached to the media path surface of the adjustable media guide wherein:

the media path surface of the second media guide includes a first face substantially parallel to a shared media path and a second surface sloped with respect to the first face.

3. The apparatus of claim 2, wherein the support structure further comprises:

a lock feature, the lock feature to be exposed when the media path surface is moved out of the rest position.

4. The apparatus of claim 3, further comprising:

a cut sheet tray assembly including:

a media tray;

a media path interface; and a tray lock mechanism that couples the cut sheet tray assembly to the lock feature when the tray lock mechanism is activated.

5. The apparatus of claim 4, wherein the cut sheet tray assembly further comprises:

a contact surface, that when interacts with the sloped second surface of the second media guide, generates a wedge effect on the second media guide and causes the second media guide to move out of the rest position.

6. The apparatus of claim 5, wherein the support structure further comprises:

a plurality of channels to accept a structure of the cut sheet tray assembly, the plurality of channels to guide the cut sheet tray assembly to move horizontally above the second media guide.

7. The apparatus of claim 6, further comprising:

a plurality of slide guides coupled to the support structure, the plurality of slide guides to guide a plurality of leg features of the second media guide to move vertically within the plurality of slide guides.

8. The apparatus of claim 7, further comprising:

a stop feature coupled to the plurality of slide guides to hinder the plurality of leg features from exiting the plurality of slide guides.

9. The apparatus of claim 3, wherein the second surface of the media path surface of the second media guide defines an aperture greater than the size of the lock feature.

10. The apparatus of claim 9, wherein the support structure defines a plurality of recesses to receive the second media guide in a compressed position, the lock feature of the support structure to be exposed through the aperture when the second media guide is in the compressed position.

11. The apparatus of claim 10, further comprising:

a bias lock interface that couples to the second media guide to sustain the second media guide in the compressed position.

12. A media guide assembly, comprising:

a support structure to extend across a media path;

a first media guide coupled to the support structure; and a second media guide moveably coupled to the support structure, wherein:

the first media guide and the second media guide are adjacent to each other with respect to a width of the media path perpendicular to a media advance direction; and the second media guide includes a surface that generates a wedge effect to move the second media guide to a lower vertical level when contacted by a horizontal force in the media advance direction.

13. The media guide assembly of claim 12, wherein:

the second media guide and the support structure include complementary sliding features to allow the second media guide to move vertically; and the support structure defines a recess to receive the second media guide.

14. The media guide assembly of claim 13, wherein:

the support structure includes a lock feature that is exposed when the second media guide is inside the recess of the support structure, the lock feature having a complimentary lock feature on an accessory attachable to the media holder at the support structure.

15. A print apparatus comprising:

a first media holder assembly including a first hub, the first hub connectable to a first roll of media;

a second media holder assembly including a second hub, the second hub connectable to a second roll of media;

a media guide assembly located between the second media holder and a shared media path leading to a print zone, the media guide assembly comprising:

a fixed media guide section having a media contact surface; and an adjustable media guide section having a media contact surface with a shape corresponding to the shape of the media contact surface of the fixed media guide section, the adjustable media guide section and the fixed media guide section aligned across a media path width perpendicular to a media advance direction; and a removable cut sheet tray coupled to a section of the support structure corresponding to the adjustable media guide section, the adjustable media guide section to, when the removable cut sheet tray is removed, move towards the fixed media guide section.

* * * * *